US010309054B1

(12) United States Patent
Guo et al.

(10) Patent No.: US 10,309,054 B1
(45) Date of Patent: Jun. 4, 2019

(54) FABRIC AND METHOD OF MANUFACTURE

(71) Applicant: Cove & Edgewater, LLC, Gardena, CA (US)

(72) Inventors: Yuehua Allen Guo, Palos Verdes Estates, CA (US); Jack Burns, Palos Verdes Estates, CA (US)

(73) Assignee: ASHFORD TEXTILES, LLC., Gardena, CA (US)

( * ) Notice: Subject to any disclaimer, the term of this patent is extended or adjusted under 35 U.S.C. 154(b) by 0 days.

(21) Appl. No.: 16/008,375

(22) Filed: Jun. 14, 2018

Related U.S. Application Data

(60) Provisional application No. 62/519,248, filed on Jun. 14, 2017.

(51) Int. Cl.

| | |
|---|---|
| ***D06P 5/24*** | (2006.01) |
| ***B41F 16/02*** | (2006.01) |
| ***B41F 17/00*** | (2006.01) |
| ***B41F 17/38*** | (2006.01) |
| ***B41J 3/407*** | (2006.01) |
| ***D06C 11/00*** | (2006.01) |
| ***D06C 15/00*** | (2006.01) |
| ***D06C 23/00*** | (2006.01) |
| ***D06C 23/02*** | (2006.01) |

(52) U.S. Cl.
CPC ..... *D06P 5/003* (2013.01); *B41F 16/02* (2013.01); *B41F 17/003* (2013.01); *B41F 17/38* (2013.01); *B41J 3/4078* (2013.01); *D06C 11/00* (2013.01); *D06C 15/00* (2013.01); *D06C 23/00* (2013.01); *D06C 23/02* (2013.01); *D06C 2700/15* (2013.01); *D06C 2700/26* (2013.01); *D06C 2700/31* (2013.01)

(58) Field of Classification Search
CPC ..... D06C 11/00; D06C 15/00; D06C 23/00; D06C 2700/15; D06C 2700/26; D06C 2700/31; D06P 5/003; D06P 5/008; D06P 5/02; B41F 16/02; B41F 17/003; B41F 17/38; B41J 3/4078
USPC ..... 347/213
See application file for complete search history.

(56) References Cited

U.S. PATENT DOCUMENTS 3,067,482 A * 12/1962 Hollowell ..... B01D 39/1623 174/124 R
6,770,581 B1 * 8/2004 DeMott ..... A47G 23/03 428/91
7,943,214 B1 * 5/2011 Bamberg ..... B41M 5/0256 428/32.17
9,181,646 B2 11/2015 Feng
(Continued)

*Primary Examiner* — Huan H Tran
*Assistant Examiner* — Alexander D Shenderov
(74) *Attorney, Agent, or Firm* — Eric Karich; Karich & Associates

(57) ABSTRACT

A method of printing and processing a fabric having first material yarns forming a technical front, and second material yarns forming a technical back, first and second material yarns being held together by a ground; carding and polishing the technical front to increase the permeability of the fabric; printing an image on the technical front of the fabric, so that ink from the printing process penetrates to the ground of the fabric; brushing and napping the technical back, after the printing process, so that ink from the technical front is pulled through the ground to the technical back, so that a mirror image of the image from the technical front is formed on the technical back.

6 Claims, 2 Drawing Sheets

(56) References Cited

U.S. PATENT DOCUMENTS

| | | | | |
|---|---|---|---|---|
| 2007/0104899 | A1* | 5/2007 | Pearl | B41J 3/28<br>428/32.24 |
| 2011/0032319 | A1* | 2/2011 | Kaplan | D06P 1/0032<br>347/101 |

* cited by examiner

FABRIC AND METHOD OF MANUFACTURE

CROSS-REFERENCE TO RELATED APPLICATIONS

This application for a utility patent claims the benefit of U.S. Provisional Application No. 62/519,248, filed 14 Jun. 2017.

BACKGROUND OF THE INVENTION

Field of the Invention

This invention relates generally to fabrics, and more particularly to a method of manufacturing and printing fabrics so that an image printed on the front is drawn through to the back so that an image is formed on both sides of the fabric.

Description of Related Art

Using prior art methods, a fabric (e.g., blanket, towel, or similar product) is first prepared for printing. The back side is brushed and napped. The front side is then printed via heat transfer printing, and the back side remains white.

It is desirable to provide a fabric formed using a unique method of manufacture that includes printing a front side, and then processing a rear side so that printing from the front side is drawn to the rear side. This is accomplished by first printing the front side of the blanket, before brushing and napping the back side. Only after printing, and after the ink/dyes penetrates to the ground, is the back side then brushed and napped. This results in the fibers from the front side being pulled through the ground to the back side, so there is mirror image of the front side is drawn to the back side.

There are many particular details in the execution of this method that must be performed correctly for this method to work, and it has required significant experimentation to determine the exact parameters of this method that result in a functional method. The details of this process are described in greater detail below.

SUMMARY OF THE INVENTION

The present invention teaches certain benefits in construction and use which give rise to the objectives described below.

The present invention provides a method of printing and processing a fabric, the method comprising the steps of providing a fabric comprising first material yarns forming a technical front, and second material yarns forming a technical back, first and second material yarns being held together by a ground; carding and polishing the technical front to increase the permeability of the fabric; printing an image on the technical front of the fabric, so that ink from the printing process penetrates to the ground of the fabric; brushing and napping the technical back, after the printing process, so that ink from the technical front is pulled through the ground to the technical back, so that a mirror image of the image from the technical front is formed on the technical back.

A primary objective of the present invention is to provide a method of manufacturing and printing fabrics, the method having advantages not taught by the prior art.

Another objective is to provide a manufacturing and printing fabrics so that an image printed on the front is drawn through to the back so that an image is formed on both sides of the fabric.

A further objective is to provide a method of printing that reduces costs and improves printing results.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a method of printing and processing a fabric that results in ink applied to the front side being pulled through the ground to the back side, so there is mirror image of an image printed on the front side formed on the back side.

Figure 1:
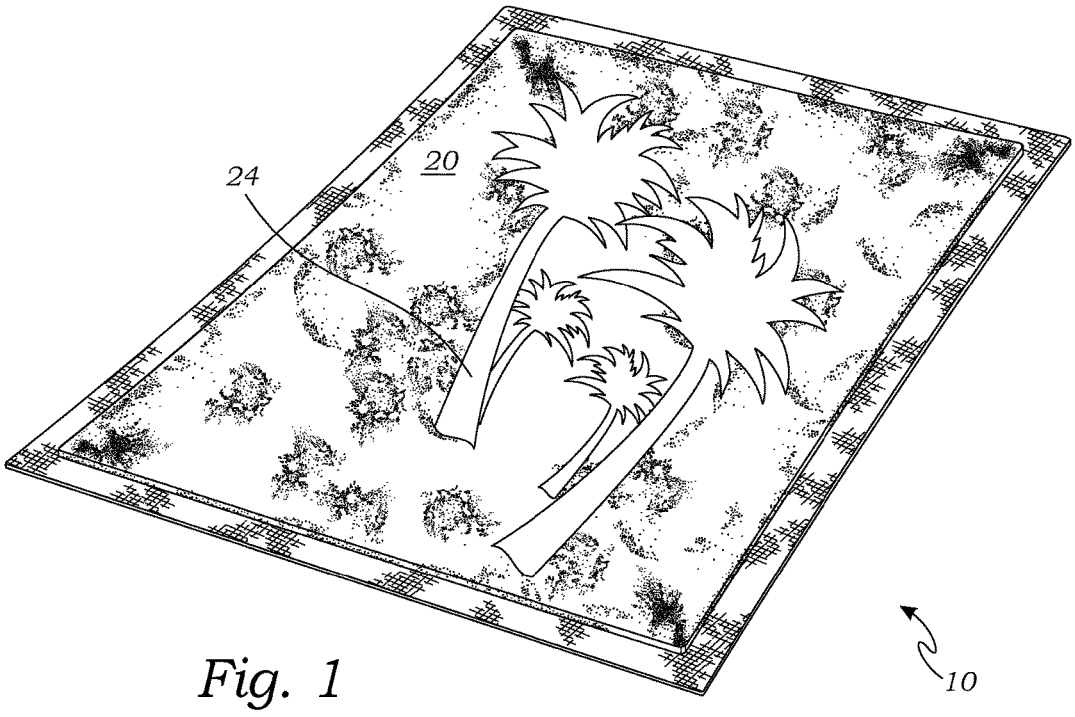
FIG. 1 is a top perspective view of a fabric according to one embodiment of the present invention.
Figure 2:
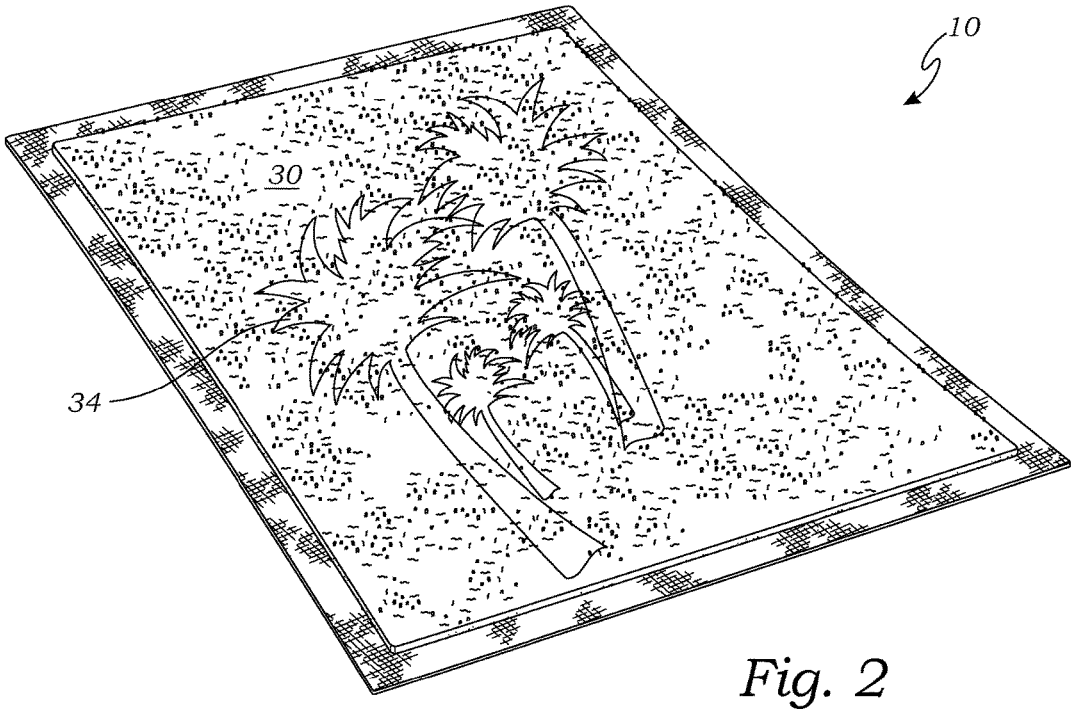
FIG. 2 is a bottom perspective view thereof.

FIG. 1 is a top perspective view of a fabric 10 according to one embodiment of the present invention. FIG. 2 is a bottom perspective view of the fabric 10, and FIG. 3 is a sectional view thereof taken along line 3-3 in FIG. 2.

Figure 3:
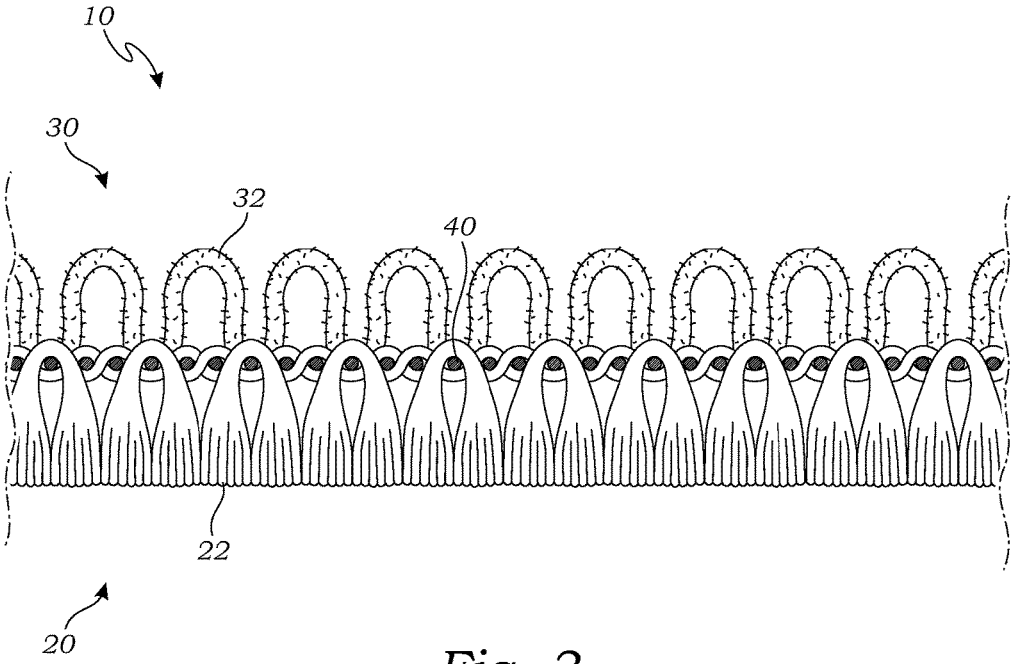
FIG. 3 is a sectional view thereof taken along line 3-3 in FIG. 2.

As shown in FIGS. 1-3, in a first embodiment the fabric 10 comprises first material yarns forming a technical front 20, and second material yarns forming a technical back 30. The technical front 20 and the technical back 30 are held together by a ground 40, as shown in FIG. 3. The materials are selected to receive a printing process, in this embodiment a heat transfer printing, onto the technical front 20. This enables a unique manufacturing process wherein the fabric 10 is printed on the technical front 20, and then processed so that the technical back 30 receives the coloring from the technical front 20.

In one embodiment, the process includes, first, providing the fabric 10, which may be knitted of manufactured in any other manner known in the art. Second, there is preferably an initial processing of the fabric 10, including stentering, carding, polishing, and drying the fabric 10, and in particular the front 20, so that the fabric 10 is softened and the yarns are opened up to receive the ink. After initial processing, the printing occurs, in this case a heat transfer printing. The printing process is performed on the technical front 20 of the fabric 10 to form an image 24.

Following printing, there are multiple post-printing steps, including brushing and napping the technical back 30. Only after printing, and after ink from the printing process penetrates to the ground 40, is the technical back 30 then brushed and napped. This results in the ink from the technical front 20 being pulled through the ground 40 to the technical back 30, so there is mirror image 32 of the technical front 20 on the technical back 30. Other steps may follow the printing, such as polishing the printed technical front 20, and polishing the technical back 30. This may be followed by further stentering.

For purposes of this application, the term "ink" is defined to include any form of ink, dye, colorant material known in the art for use in coloring or forming images on fabrics. In the preferred embodiment, the ink used may be in the form of "highly concentrated" ink. The term "highly concentrated" is a term of art known in the field of printing that refers to a particular form of ink. For purposes of this application, the term "highly concentrated" is defined to refer to this particular known type of ink, and not just to any ink that is simply of greater concentration. The paper used is high absorption paper, also a term of art known by those skilled in the art, that refers to paper that absorbs an amount of ink that is greater than normally used, for greater ink transfer capacity. Both of these are important to have deep penetration to the ground 40 of the fabric 10.

The preprinting process of the carding and polishing before printing, will open up the fiber to increase its permeability, and further increases the fluffiness of the fabric 10. This is one of the key processes which allow the maximum ink/dye penetration required for the present invention. This softening process performed before heat transfer printing will reduce the fabric's resistance to the diffusion of the ink and dye.

The transfer process must have a suitable combination of temperature, pressure, and transit time through the press (thereby increasing total pressure applied). Through months of testing it has been found that there are several factors that are essential to the success of this method. First, it should be heated to between 195-215, preferably about 205 C, which is significantly higher than standard 180 C heating processes. Second, the transfer time should be at least 50 seconds, preferably about 56.8 seconds. This is about 3 times the normal speed of operation; however, the increased time results in greater total pressure being applied, which results in the required diffusion and penetration of the ink required by the current process.

After heat transfer printing, the fabric will go through the carding polishing on the printed side first, to further enhance penetration so that the ink/dye penetrates to the back side to achieve mirror images/colors on the back side.

As used in this application, the words "a," "an," and "one" are defined to include one or more of the referenced item unless specifically stated otherwise. The terms "approximately" and "about" are defined to mean +/−5%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application.

What is claimed is:

1. A method of printing and processing a fabric, the method comprising the steps of:

providing a fabric comprising first material yarns forming a technical front, and second material yarns forming a technical back, first and second material yarns being held together by a ground;

carding and polishing the technical front to increase the permeability of the fabric;

printing an image on the technical front of the fabric, so that ink from the printing process penetrates to the ground of the fabric;

brushing and napping the technical back, after the printing process, so that ink from the technical front is pulled through the ground to the technical back, so that a mirror image of the image from the technical front is formed on the technical back.

2. The method of claim 1, wherein the printing is in the form of heat transfer printing.

3. The method of claim 2, wherein the heat transfer printing is performed at about 205 C for about 56.8 seconds transit time.

4. The method of claim 3, wherein the printing utilizes a high concentration ink, and the printing is performed at 205 C.

5. The method of claim 1, further comprising the steps of, after printing, performing further carding and polishing on the technical front, to further enhance penetration so that the ink penetrates to the technical back.

6. A method of printing and processing a fabric, the method comprising the steps of:

providing a fabric comprising first material yarns forming a technical front, and second material yarns forming a technical back, first and second material yarns being held together by a ground;

carding and polishing the technical front to increase the permeability of the fabric;

printing an image on the technical front of the fabric via heat transfer printing at a temperature of about 205 C, for at least 50 seconds, so that ink from the printing process penetrates to the ground of the fabric;

brushing and napping the technical back, after the printing process, so that ink from the technical front is pulled through the ground to the technical back, so that a mirror image of the image from the technical front is formed on the technical back; and performing further carding and polishing on the technical front, after printing, to further enhance penetration so that the ink penetrates to the technical back.

* * * * *